US006234311B1

(12) United States Patent
Francois

(10) Patent No.: US 6,234,311 B1
(45) Date of Patent: May 22, 2001

(54) SHOCK-ABSORBING SYSTEM FOR CONTAINERS OF RADIOACTIVE MATERIAL

(75) Inventor: Dominique Francois, Pont Saint Esprit (FR)

(73) Assignee: Transnucleaire SA, Paris (FR)

( * ) Notice: Subject to any disclaimer, the term of this patent is extended or adjusted under 35 U.S.C. 154(b) by 0 days.

(21) Appl. No.: 09/447,181

(22) Filed: Nov. 22, 1999

(30) Foreign Application Priority Data

Nov. 23, 1998 (FR) ..... 98 14868

(51) Int. Cl.[7] ..... B65D 81/02
(52) U.S. Cl. ..... 206/521; 206/584; 250/507.1
(58) Field of Search ..... 206/521, 584; D9/456; 428/402; 250/507.1

(56) References Cited

U.S. PATENT DOCUMENTS 3,304,219 * 2/1967 Nickerson .
3,667,593 * 6/1972 Pendleton ..... 206/584
3,999,653 * 12/1976 Haigh et al. ..... 206/584
4,423,802 * 1/1984 Botzem et al. ..... 188/377
4,621,022 * 11/1986 Kohaut et al. ..... 428/402
4,972,087 * 11/1990 Neider et al. ..... 250/507.1
5,312,665 * 5/1994 Pratt et al. ..... 428/402

FOREIGN PATENT DOCUMENTS 39 29 491 3/1990 (DE) .
40 25 257 2/1992 (DE) .
0 035 064 9/1981 (EP) .
1 411 473 12/1965 (FR) .

OTHER PUBLICATIONS

Patent Abstracts of Japan, Publication No. 04042097, Publication Date Dec. 2, 1992.
XP–002111577, Derwent Document, Jul. 1987.

* cited by examiner

*Primary Examiner*—David T. Fidei
(74) *Attorney, Agent, or Firm*—Pearne & Gordon LLP

(57) ABSTRACT

Shock-absorbing system integral with a transport or storage container for radioactive material, characterised in that it comprises at least one casing (4,7) covering at least part of said container (1,2) and forming an enclosed space filled with a stack of elementary pieces (6) having at least three converging axes of symmetry whose symmetry in rotation is at least 3-fold, for example small, solid or hollow spheres.

17 Claims, 2 Drawing Sheets

SHOCK-ABSORBING SYSTEM FOR CONTAINERS OF RADIOACTIVE MATERIAL

TECHNICAL FIELD

The present invention relates to shock-absorbing systems arranged around containers (or packaging) of radioactive material, in particular those having a weight ranging from a few tonnes to more than 100 or 150 tonnes, generally used for the transport and/or storage of irradiated nuclear fuel or for any other radioactive material; with these systems the said packaging is able to withstand prescribed drop tests under conditions such that they fulfil the safety criteria required by regulations applying to the transport or storage of said radioactive material.

STATE OF THE PRIOR ART

Transport and/or storage containers for irradiated fuel or for any other radioactive material, due to the need for shielding against radiation, often have thick metal walls (for example several centimetres to several tens of centimetres thick) in steel or cast iron whose weight is therefore high ranging from a few tonnes to over 150 tonnes.

Generally these metal containers comprise at least one thick cylindrical sleeve inside which the radioactive material or fuel elements are placed, closed at its two ends by a base and a lid that are also thick. They are usually handled by means of kingpins fixed to the sleeve. The cylindrical sleeve may have a straight, circular or polygonal (rectangular, square . . . ) cross-section.

All these containers must be fitted with shock-absorbing systems to enable them to withstand the tests laid down by applicable regulations, in particular the so-called free-fall test from a height of 9 metres. The shock absorbers must be designed such that they are effective at all possible angles of fall.

In general, these shock-absorbing devices comprise metal casings which cap the ends of the container and project beyond the metal body such as to provide not only against vertical falls along the longitudinal axis of the container, but also against lateral falls (along an axis perpendicular to the previous axis) or oblique falls (at the end corners of the container).

Figure 1:
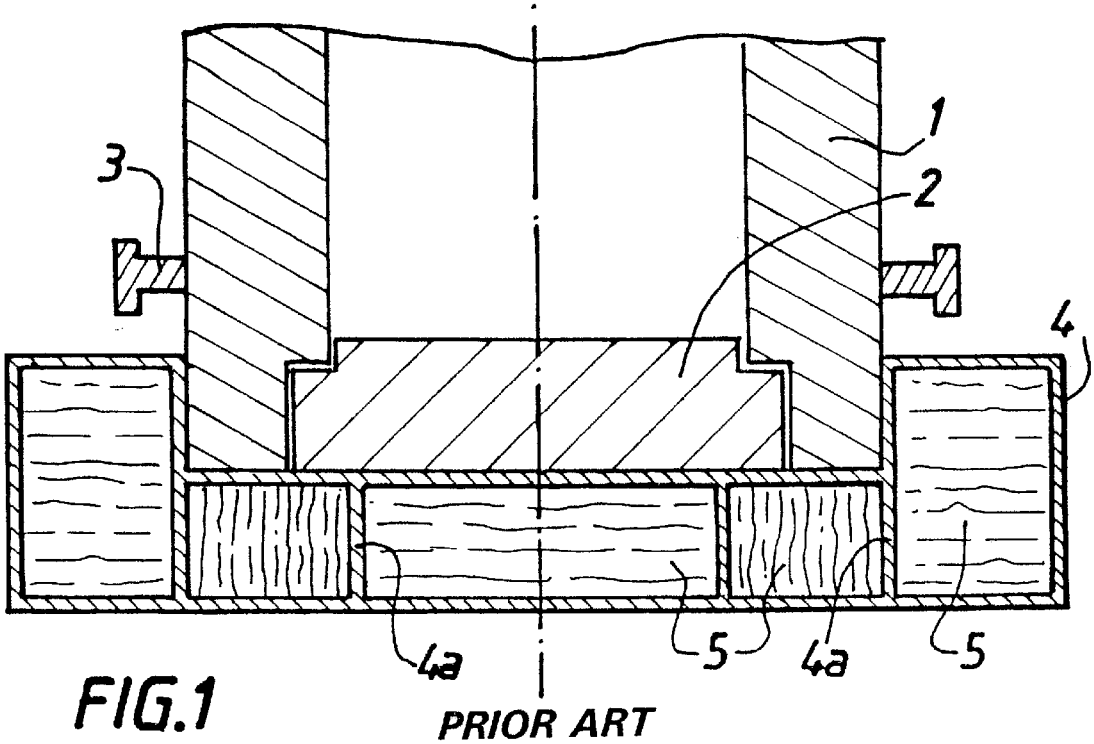

FIG. 1 shows an example of a known shock-absorbing device, capping the end of a container and comprising a sleeve (1) closed by a lid (2) and handled by means of kingpins (3). Said shock-absorbing device comprises a metal casing (4) divided into compartments filled with wood pieces (5) whose fibres are orientated to provide efficient shock absorption in several directions; it can be seen that the result is limited to obtaining efficient shock absorption only when the stress due to impact is exerted in a direction parallel to the fibres. Therefore, with this shock-absorbing device it is not possible to obtain isotropic shock absorption (that is to say having the same efficiency irrespective of the angle of fall) over the entire surface of the casing.

It is known to replace said partitioned casing filled with wooden pieces by a solid metal cover as soft as aluminium for example according to U.S. Pat. No. 4,806,771. The use of solid metal as a shock absorber has the advantage of being isotropic and of having crush properties that are well identified, reproducible and stable in time. On the other hand, it leads to a significant increase in weight and, since solid metal has high crush resistance, the accelerations transmitted to the container during a fall are also high, generally higher than those obtained with a wood-filled casing, which can limit its area of use.

To have a shock-absorbing system that is less stiff than solid metal and lighter in weight, it is known to use, as for example in U.S. Pat. No. 3,675,746, a plurality of metal tubes arranged and stacked in a larger tube. This kind of system has sufficient resistance to crushing in a direction perpendicular to the major axis of the tubes; on the other hand it is much too high in the axial direction (buckling) when shock absorption is too inflexible and inefficient. Therefore, even by placing these tubes in a partitioned casing and by arranging them in each compartment in a particular orientation, it would at the most only be possible to reduce the anisotropy of shock absorption as is obtained with wood-filled casings having varied fibre orientations as described above.

To improve the isotropy of shock-absorption, patent JP 04042097 is known to use a partitioned casing, each compartment being filled with small metal pieces, in bulk, of Raschig ring type or sectioned pieces of extruded aluminium for example.

Since said small pieces have individual anisotropic behaviour, they can only bring average improvement in the isotropy of shock-absorption and under certain conditions:

- firstly random stacking must be made, the orientation of each piece needing to be different to that of neighbouring pieces; the average isotropy obtained in this way, despite the anisotropic behaviour of each piece, cannot exclude all risks of anisotropic stacking:
- also, stacking must under all circumstances remain as regular as possible with good cohesion of the pieces, the spaces between them being as small and regular as possible such as to ensure homogeneous distribution of the pieces; this condition for acceptable shock-absorbing isotropy can only be partly achieved, since it is little compatible with the first condition of random piece distribution which leads to each piece having a different orientation; therefore the presence of compartments in the casing is essential to promote, and especially endeavour to maintain, a sufficiently homogeneous distribution of the pieces while limiting their possibility of movement.

Despite these precautions, it can be seen that with such a system it is difficult to prove vis-á-vis regulations in force that shock absorption is intrinsically isotropic, the risks of anisotropic stacking not being entirely eliminated, and that the distribution of the pieces is sufficiently homogeneous in each compartment or from one compartment to another.

Having regard to these disadvantages, the applicant has endeavoured to find a system providing shock absorption in the event of fall of the container that is intrinsically isotropic from every possible angle while remaining homogenous, as light as possible and easy to implement.

DESCRIPTION OF THE INVENTION

The invention is a shock-absorbing system integral with a container, typically a metal transport or storage container for radioactive material, characterised in that it comprises at least one casing covering said container at least in part and forming an enclosed space filled with a stack of elementary pieces having at least three converging axes of symmetry, whose symmetry in rotation is at least 3-fold, that is to say that, from a given point, a rotation of no more than 120° C. must be made to obtain an identical point.

The point of intersection of these axes preferably forms a centre of symmetry of the piece which is therefore a piece with centred symmetry.

Hence these elementary pieces comprise regular polyhedrons such as tetrahedrons with equilateral surfaces, cubes and all regular polyhedrons having a greater number of equal surfaces, but also spheres.

It is particularly advantageous to use a cube, or especially a sphere which have centred symmetry, the sphere also having a simple form and an unlimited number of axes of symmetry, and hence having perfect homogeneity and isotropy.

These pieces may be in varied materials provided that they have sufficient deforming ability, for example ceramic, resin, whether reinforced or not. Generally metal pieces are used, preferably in steel, aluminium, copper or their alloys, which have a good ability to deform while absorbing high energy without breaking under strong impact, as is the case with the fall of a container.

If the elementary pieces are in resin, solid pieces can be used, but if the elementary pieces are in metal it is particularly advantageous for them to be hollowed out, while paying heed to the aforementioned conditions of symmetry so that they may deform more easily.

In general a casing is fixed to each end of the container and therefore covers the ends of the sleeve, the base and lid; its projecting part also protects the ends of the side wall of the sleeve. The casing may cover the end of the container fully or only in part; in this latter case it typically has the form of a ring with a straight L-shaped cross section covering the end corner of the container and leaving partly exposed the centre of the lid or base. Intermediate casings can be fitted filled with elementary pieces of the invention, encircling the sleeve between its ends.

The casings are generally metal or made in sheet steel of sufficient thickness to withstand deformation through the weight of the spheres under usual handling conditions and during installation of the casing, while nonetheless being sufficiently thin so that it deforms without breaking in the event of a fall. The thickness of the steel sheet is typically between 2 and 8 mm according to the weight of the container to be protected. Casings may also be in other materials, for example plastic materials.

Provision can be made to improve the rigidity of the casings using any type of outer or inner reinforcement, for example cross-ties connecting two walls of said casing and arranged between the filling spheres. They may contribute to shock absorption. Said casing is particularly effective while being simple to produce, the presence of compartments not being compulsory.

The enclosed space formed by the casing also has a height(or thickness) generally between 10 and 100 cm; its height increases with the desired level of absorption (for heavier containers for example) or with the ease of deformation of the elementary pieces.

Also, the fact that symmetrical pieces according to the invention are used, means that it is easy to achieve regular, compact and homogeneous stacking within the entire enclosed space without it being necessary to take any special precautions. In particular the spheres place themselves in position randomly and then arrange themselves automatically; there is no risk of stack separation. Therefore the use of symmetrical elementary pieces such as spheres with centred symmetry, that are therefore isotropic and lead to isotropic stacking, provides isotropic absorption through construction, irrespective of the angle of fall.

The elementary pieces advantageously have an average diameter of between 20 and 80 mm. If they are too small, their production and in particular their hollowing out will result in parts that are thin which may cause problems, and if they are too big the distributed homogeneity of crush resistance may be affected.

It is advantageous for the ratio between the height of the casing enclosure and the diameter of elementary pieces to lie between 2 and 20%.

When the elementary pieces are hollowed out, metal spheres in particular, they are preferably hollow pieces having a constant wall thickness; but they may also be obtained from solid pieces in which several identical holes of constant diameter have been pierced, possibly crossing from one side to another, whose distribution must at all times pay heed to the conditions of symmetry described above.

The hollowing rate (ratio between the hollowed volume and the volume of the piece) is adapted to desired crush resistance. This generally lies between 30 and 90%, preferably between 40 and 80%. For hollow pieces with walls of constant thickness, the ratio between wall thickness and average diameter, based upon the greater size or the circumscribed circle, is typically between 0.03 and 0.3 which is in conformity with the above-mentioned ranges of hollowing rates.

The elementary pieces of the invention, in particular the hollowed-out pieces, deform under impact and it is remarkable to ascertain that, contrary to the use of tubular pieces, they have the property—due to their specific symmetry characteristics—of deforming in identical or closely similar manner irrespective of the direction of the effort applied, and that they therefore give the shock-absorbing system of he invention an isotropic impact absorption that is effective irrespective of the angle of fall.

Also, it can be seen that by combining the diameter of the elementary pieces and their hollowing rate, it is possible to adapt the system of the invention to all types of containers while maintaining the essential property of isotropic behaviour.

Therefore for one same type of casing, of constant volume for example and adaptable to containers having a constant outer diameter and varying lengths, it is possible to vary the size and/or the hollowing rate of the pieces filling said casing such as to adapt the shock-absorbing characteristics of the system of the invention to the weight of the container, which varies according to its length and load.

In general the elementary pieces are all identical, however pieces of different diameter or different hollowing rate can be used in one same casing, for example placed in superimposed beds, to obtain progressive shock-absorbing characteristics.

It is also advantageously possible, after the elementary pieces have been positioned, to add a binder to the casing (for example cement, glue, resin) which spreads out into the interstices between said pieces; after solidification this will improve their cohesion, in particular if they are not all identical, or can prevent their dispersion in the event of partial tearing of the casing, while maintaining their shock-absorbing capacity.

It is seen that the system of the invention can easily be used for all types of containers from the heaviest to the lightest; all that is required is to adapt the size and hollowing rate of the elementary metal pieces to give them the necessary crush resistance characteristics to provide shock absorption for the container under consideration.

It is to be noted that the symmetry of the pieces of the invention is not considered to be affected by the presence of defects or residues connected for example with the manufacturing process of said pieces (such as non-trimmed parts, access holes to the inner cavity, machining marks etc.) and not having the symmetry of the invention, insofar as said defects are not of a kind to significantly jeopardise the isotropic behaviour of the pieces. In other words, pieces whose symmetry is at least 3-fold comprising this type of defect come under the scope of the invention.

Figure 2:
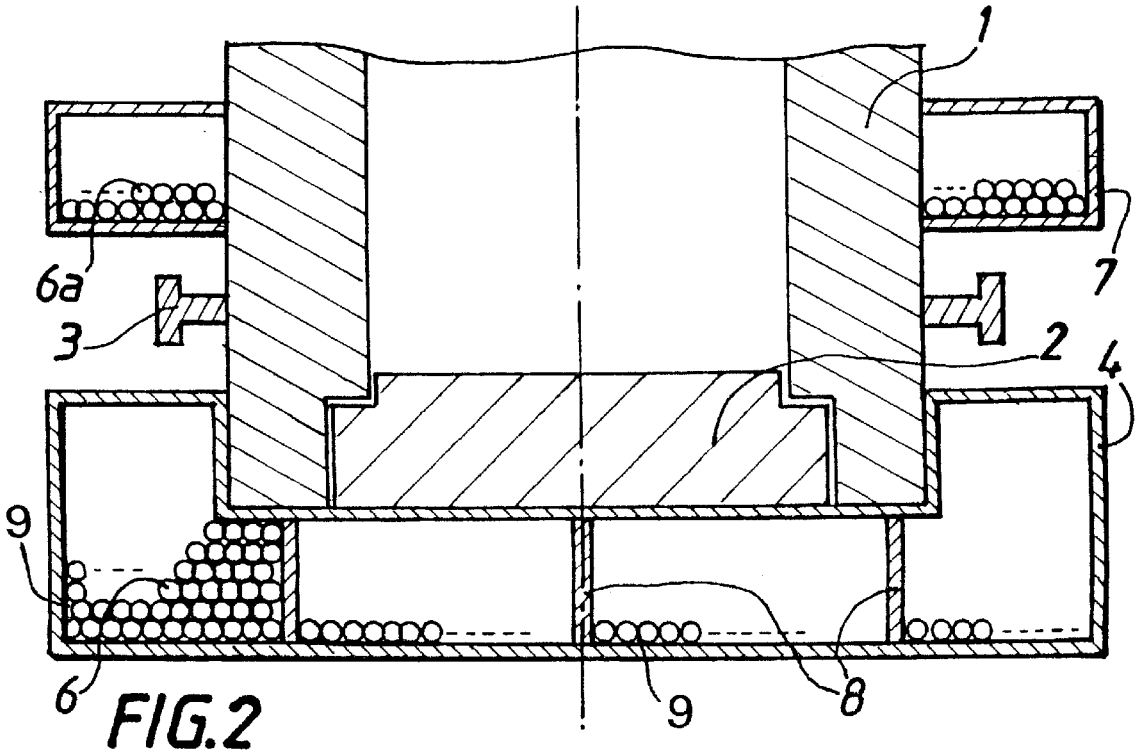
Figure 3A:
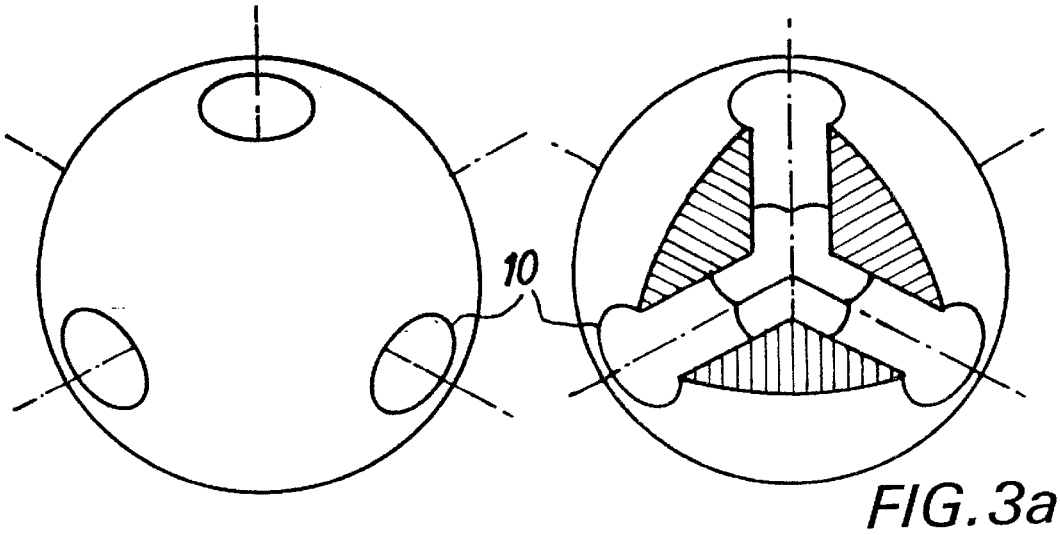
Figure 3B:
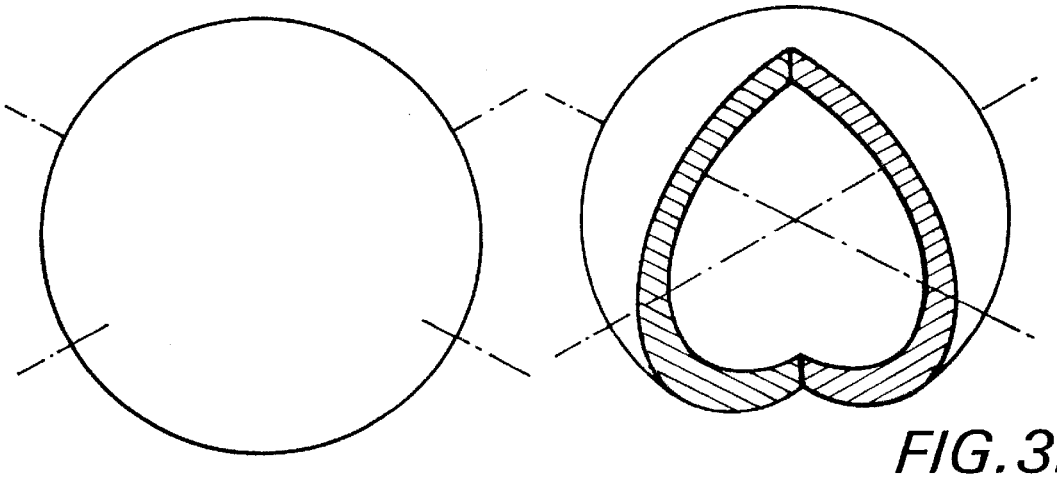
Figure 3C:
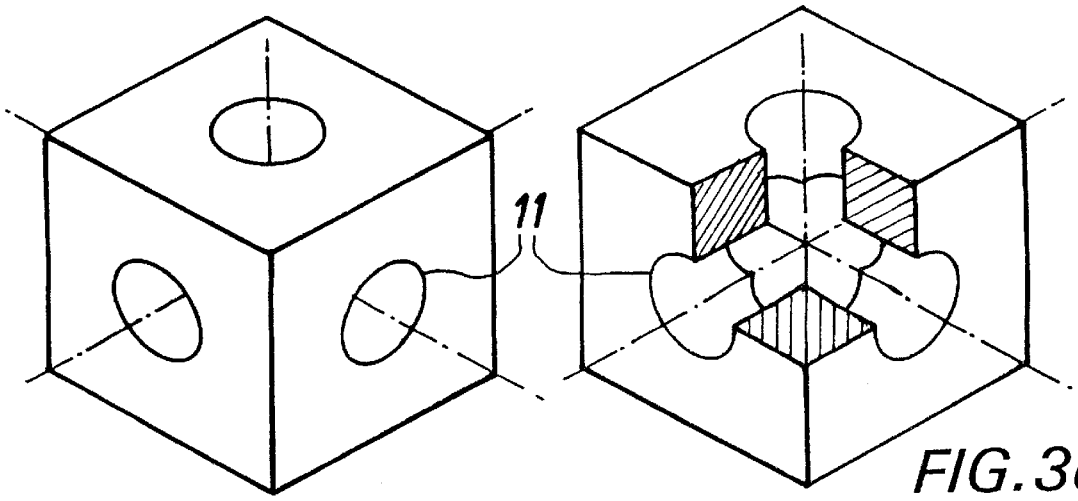

FIG. 1 illustrates the shock-absorbing system of the prior art comprising a partitioned casing filled with wood, FIG. 2 illustrates a container equipped at one of its ends with a shock-absorbing system of the invention, FIGS. 3*a–c* illustrates different types of hollowed-out pieces with centred symmetry.

In FIG. 1 can be seen the thick metal sleeve (1) for the container already described, closed at one end by a thick lid (2). The container is handled by kingpins (3). A casing (4) caps the entire end of the container and its projecting part protects the end of the outer wall of sleeve (1).

This casing is divided into compartments by walls (4*a*), each of the compartments containing a piece of wood whose fibres are suitably oriented. It is noticed that the shock absorption at a determined spot is dependent both upon the direction of the wood fibres and on the direction of impact in relation to said fibres.

Findings of the same type would be made if the wood was replaced by a stack of arranged tubes whose orientation is the same as the fibres.

In FIG. 2, which illustrates the invention, it can be seen that casing (4) is filled with hollowed-out spheres (6) that are all identical (only a few are shown) and that it caps the entirety of the end of the container. The casing comprises inner stays (8). It could only cap part of the container end and leave exposed part of lid (2) when it would form a ring with an L-shaped straight cross-section.

It is also seen that the sleeve is fitted with an intermediate casing (7) encircling it according to the invention. It is filled with hollowed-out spheres (6*a*) different to those of the end casing since the crush resistance properties desired in this zone are not the same.

It is also possible, after the casing (4,7) has been filled with hollowed-out spheres (6,6*a*), to add a binder (9) which spreads out into interstices between the spheres (6,6*a*).

FIG. 3 which illustrates the hollowed-out elementary pieces of the invention shows firstly in FIG. 3*a* a side view exploded diagram of the spheres in which holes (10) have been pierced such as not to disturb the centred symmetry of the piece. It can be seen that there is a hole (10) leading at the surface to each of the ends of a 3-axis system having perpendicular symmetry, and that each of the holes centred on one of the axes of symmetry crosses right through the sphere via its centre. The sphere with its holes maintains a 4-fold symmetry.

It is also possible to make 4 holes positioned on the apexes of an equilateral tetrahedron within the sphere which cross through the tetrahedron from its apexes to its centre or to the centre of the opposite surfaces.

FIG. 3*b* gives an exploded side view of an elementary piece in the shape of a hollow sphere. This type of piece may comprise traces of its manufacturing process in the form of a hole whose diameter may for example reach approximately 10 mm for hollow spheres having a diameter of 60 to 80 mm.

FIG. 3*c* is an exploded side view showing an elementary piece in cube shape having a hole (11) centred on the axis of symmetry of each of its surfaces, said hole crossing right through the cube via its centre. These holes do not deteriorate the symmetry of the cube.

What is claimed is:

1. Shock-absorbing system integral with a transport or storage container for radioactive material, said system comprising at least one casing covering said container at least in part and forming an enclosed space filled with a stack of elementary pieces having at least three converging axes of symmetry, wherein each converging axis of symmetry in rotation is at least 3-fold.

2. System according to claim 1, in which the elementary pieces have a centre of symmetry which is the converging point of the axes of symmetry.

3. System according to claim 1, in which the elementary pieces are chosen from the group comprising spheres and regular polyhedrons.

4. System according to claim 1, in which the elementary pieces are made in a metal chosen from the group comprising steel, aluminium, copper and their alloys.

5. System according to claim 1, in which the elementary pieces are hollowed out.

6. System according to claim 5, in which the elementary pieces are hollow pieces having a wall of constant thickness.

7. System according to claim 5, in which the elementary pieces are pieces crossed by holes having a constant diameter arranged symmetrically maintaining the symmetry of said elementary pieces that is at least 3-fold.

8. System according to claim 5, in which the hollowing rate of the hollowed-out elementary pieces, defined as the ratio between the hollowed volume and the volume of the piece, lies between 30 and 90%.

9. System according to claim 8, in which the hollowing rate of the elementary pieces is between 40 and 80%.

10. System according to claim 6, in which the hollow elementary pieces having a wall of constant thickness have a ratio between the thickness of their matter and their average diameter that is between 0.03 and 0.3.

11. System according to claim 1, in which the elementary pieces have an average diameter of between 20 and 80 mm.

12. System according to claim 1, in which the height of the enclosed space formed by the casing lies between 10 and 100 cm.

13. System according to claim 1, in which the casing has reinforcements within the enclosed space formed by cross-ties.

14. System according to claim 1, in which the elementary pieces are embedded in a binder.

15. Transport or storage container for radioactive material comprising at least one shock-absorbing system comprising at least one casing covering at least part of said container and forming a closed space filled with a stack of elementary pieces having at least three converging axes of symmetry wherein each converging axis of symmetry in rotation is at least 3-fold.

16. Container according to claim 15, comprising a shock-absorbing system at each end of the container.

17. Container according to claim 16, also comprising at least one shock-absorbing system around a sleeve connecting said container ends.

* * * * *